US010919660B1

(12) United States Patent
Tsujimura

(10) Patent No.: US 10,919,660 B1
(45) Date of Patent: Feb. 16, 2021

(54) LABELING APPARATUS

(71) Applicant: TOSHIBA TEC KABUSHIKI KAISHA, Tokyo (JP)

(72) Inventor: Hisashi Tsujimura, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/526,158

(22) Filed: Jul. 30, 2019

(51) Int. Cl.

| | |
|---|---|
| ***B65C 9/26*** | (2006.01) |
| ***B65C 9/40*** | (2006.01) |
| ***B65C 9/14*** | (2006.01) |
| ***B65C 9/02*** | (2006.01) |

(52) U.S. Cl.
CPC ..... *B65C 9/26* (2013.01); *B65C 9/02* (2013.01); *B65C 9/14* (2013.01); *B65C 9/40* (2013.01)

(58) Field of Classification Search
CPC .... B65C 9/02; B65C 9/14; B65C 9/26; B65C 9/40; B65C 2006/401; B65C 2009/401; B65C 9/42
See application file for complete search history.

(56) References Cited

U.S. PATENT DOCUMENTS 5,954,913 A * 9/1999 Wurz ..... B65C 1/021 156/360
2014/0096900 A1* 4/2014 Wojdyla ..... B65C 9/1803 156/247
2016/0052659 A1* 2/2016 Bowers ..... B65C 9/1826 156/64

FOREIGN PATENT DOCUMENTS

JP 2005-075379 A 3/2005

* cited by examiner

*Primary Examiner* — George R Koch
(74) *Attorney, Agent, or Firm* — Kim & Stewart LLP

(57) ABSTRACT

A labeling apparatus includes a label holder and a controller. The label holder is configured to move between a retracted position and an extended position that is closer to a conveyer than is the retracted position, and receive a label on an end of the label holder facing the conveyer. The controller is configured to control the label holder to move towards a standby position between the retracted position and the extended position until an object to be labeled is conveyed on the conveyer to a position facing the label holder, and then towards the extended position such that the label is attached to the object.

18 Claims, 10 Drawing Sheets

342

| 3421 | 3422 |
| --- | --- |
| BOX N1 | FIRST MOVEMENT DISTANCE |
| BOX N2 | SECOND MOVEMENT DISTANCE |
| BOX N3 | THIRD MOVEMENT DISTANCE |

LABELING APPARATUS

FIELD

Embodiments described herein relate generally to a labeling apparatus.

BACKGROUND

A labeling apparatus is known to attach a label to an object such as a box conveyed by a belt conveyor or the like. In such a labeling apparatus, a label attaching member provided in an arm moves a label printed and issued by a label printer to a position to attach the label to the object.

The belt conveyor conveys the object to, and then stops the object at, an attaching position. The label printer prints the label to be attached to the object. The labeling apparatus moves the label printed by the label printer to a label attaching position and then attaches the label to the stationary object. The belt conveyor then conveys the now-labeled object.

In accordance with the development of home delivery services, the number of objects handled by the distribution industry is increasing, and thus more objects are conveyed by the belt conveyor. To convey the increased amount of objects, an interval between objects conveyed by the belt conveyor may need to be narrowed. Therefore, when the time taken to stop the object for attachment of the label is long, the objects to be labeled may excessively stagnate. For these reasons, it is desirable to reduce the time taken for attachment of the label.

DETAILED DESCRIPTION

According to an embodiment, a labeling apparatus includes a label holder and a controller. The label holder is configured to move between a retracted position and an extended position that is closer to a conveyer than is the retracted position, and receive a label on an end of the label holder facing the conveyer. The controller is configured to control the label holder to move towards a standby position between the retracted position and the extended position until an object to be labeled is conveyed on the conveyer to a position facing the label holder, and then towards the extended position to attach the label to the object.

Hereinafter, an example embodiment of a labeling apparatus is described with reference to the accompanying drawings. In this example embodiment, a box is described as an example of an object to be labelled. A CPU is described as an example of a processor. However, the example embodiment is merely one possible embodiment of a labeling apparatus, and to the present disclosure is not limited to the particular example(s).

Figure 1:
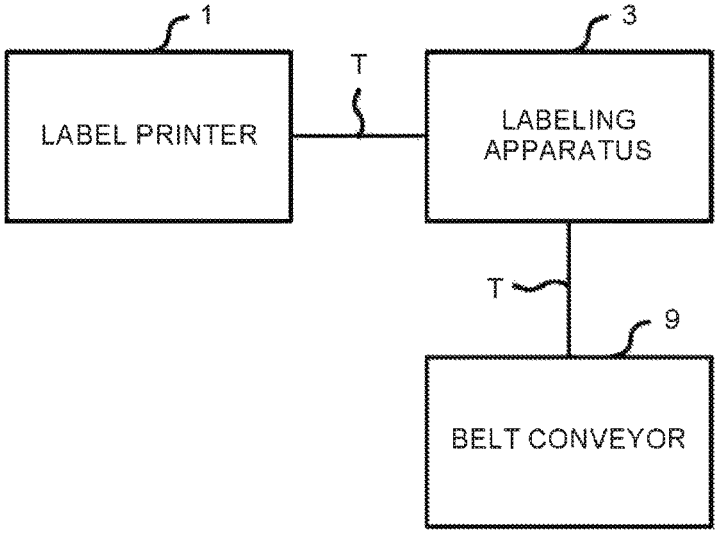
FIG. 1 illustrates a labeling system including a label printer, a labeling apparatus, and a belt conveyor according to an embodiment.

FIG. 1 illustrates a labeling system including a label printer 1, a labeling apparatus 3, and a belt conveyor 9 according to an embodiment. As shown in FIG. 1, the label printer 1 and the labeling apparatus 3 are connected to each other in a communicable manner via a communication line T such as an LAN (Local Area Network). The labeling apparatus 3 and the belt conveyor 9 are connected to each other in a communicable manner via the communication line T such as the LAN.

Figure 2:
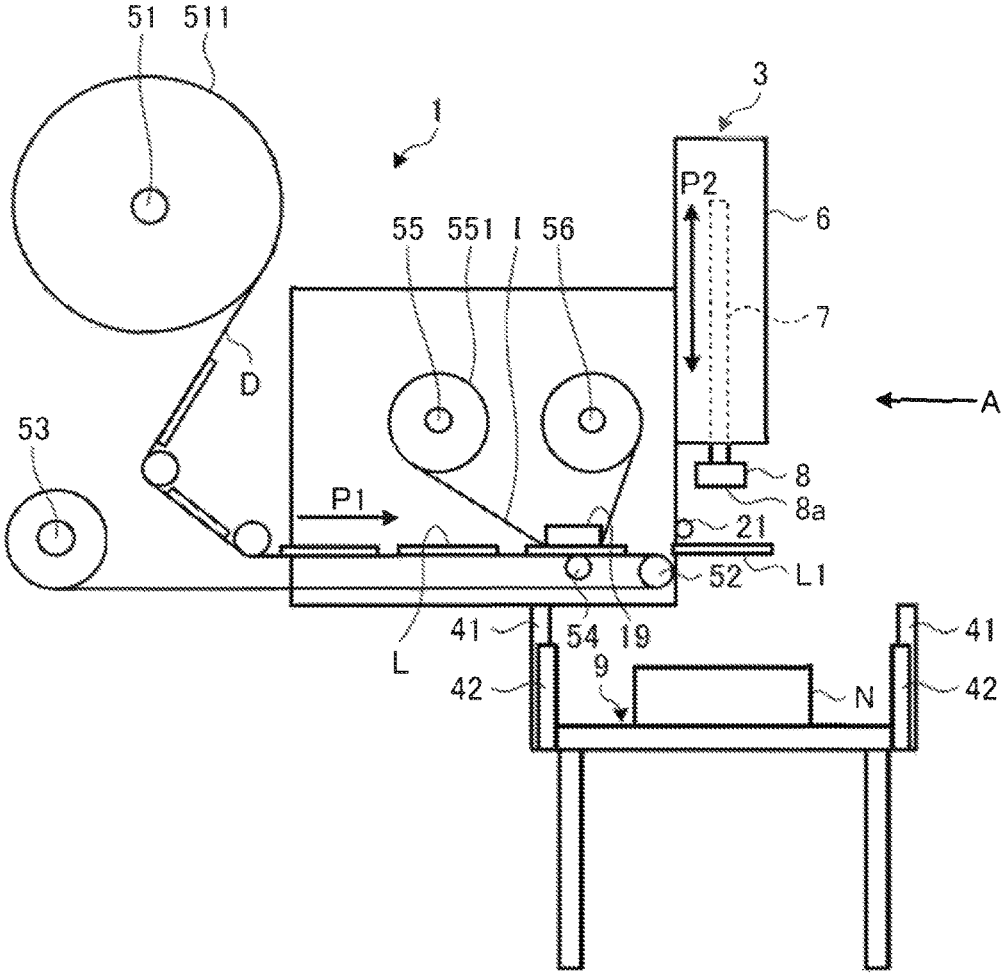
FIG. 2 is a diagram schematically illustrating an example of configurations of the label printer, the labeling apparatus, and the belt conveyor.

Next, the configurations of the label printer 1, the labeling apparatus 3, and the belt conveyor 9 are described. FIG. 2 is a diagram schematically illustrating an example of configurations of the label printer 1, the labeling apparatus 3, and the belt conveyor 9. As shown in FIG. 2, the label printer 1 includes a label supply shaft 51, a label issuing shaft 52, a label winding shaft 53, a printing section 19, a platen 54, a ribbon supply shaft 55, and a ribbon winding shaft 56. The label supply shaft 51 rotatably supports a roll-like label paper 511 in which a plurality of labels L is continuously attached to a long mount D. The label issuing shaft 52 rapidly folds the mount D. When the label issuing shaft 52 rapidly folds the mount D, the label L is peeled off from the mount D. The peeled label L1 is issued to the outside from a label issuing port 48 (refer to FIG. 3). The label winding shaft 53 winds the mount D folded by the label issuing shaft 52.

The ribbon supply shaft 55 supports a roll-like ink ribbon 551 impregnated with heat-melt ink. The ribbon winding shaft 56 is fed from the roll-like ink ribbon 551 and winds an ink ribbon I used for printing on the label L.

The printing section 19 includes many heat generation elements arranged in a line. The platen 54, which is a label conveyance section 20 (refer to FIG. 4), is rotated by a motor. The printing section 19 and the platen 54 are positioned in the middle of a conveyance path of the label paper 511 fed from the label supply shaft 51. The printing section 19 and the platen 54 sandwich the conveyed label L and the ink ribbon I. The printing section 19 applies heat to the ink ribbon I when the heat generation element generates heat, transfers the melted ink onto the sandwiched label L to print characters, figures, and the like.

The platen 54 rotates to convey the sandwiched label L, the mount D, and the ink ribbon I in a direction in which the label L is dispensed (in the direction indicated by an arrow P1). If the platen 54 rotates, the label L attached to the mount D is fed from the label paper 511. Then, the fed label L is conveyed to the printing section 19. The printing section 19 performs printing on the label L. The printed label L is conveyed towards the label issuing shaft 52 (in the direction indicated by the arrow P1). Next, when the label winding shaft 53 winds the mount and the label issuing shaft 52 rapidly folds the mount D, the label L is dispensed from the label issuing port 48 as a label L1 due to its own rigidity. A label issuing sensor 21 detects whether or not the label L1 dispensed from the label issuing port 48 is present at the label issuing port 48. In a state in which the label L1 is dispensed from the label issuing port 48, the presence of the label L1 at the label issuing port 48 is detected by the label issuing sensor 21. If the label L1 dispensed from the label issuing port 48 is sucked and moved by a suction section 8 described below, the presence of the label L1 at the label issuing port 48 is not detected by the label issuing sensor 21.

Next, the labeling apparatus 3 is described. The labeling apparatus 3 has a hollow cylindrical cylinder 6. The labeling apparatus 3 includes an arm 7 in the cylinder 6. The arm 7 can move up and down in the cylinder 6 in a direction indicated by an arrow P2. The arm 7 moves up and down in the cylinder 6 using air pressure, for example.

A tip on a lower side of the arm 7 includes the suction section 8. As the arm 7 moves up and down, the suction section 8 moves up and down correspondingly. The suction section 8 has a planar shape and suctions the label L1 from a lower surface 8*a* by a label suction section 45 (refer to FIG. 5) that applies negative pressure. The suction section 8 is positioned directly above the label L1 dispensed from the label issuing port 48, and suctions the label L1 dispensed the label issuing port 48 to move the label L1 downward while moving downward.

The suction section 8 can stop at a home position, a stand by position, and a label attaching position. The suction section 8 may also be referred to as a label attaching member. The home position is a position at which the suction section 8 is retracted (the position in FIG. 10). The stand by position is separated from a box N by a predetermined distance and to which the suction section 8 further falls while sucking the label L1 dispensed from the label issuing port 48 (refer to FIG. 11). The label attaching position is a position below the stand by position by a predetermined distance, and has the same height as an upper surface NU (refer to FIG. 12) of the box N. In other words, the standby position is a positioned at a height between the home position, which is the highest position, and the label attaching position, which is the lowest position.

The belt conveyor 9 is positioned approximately directly below the labeling apparatus 3. The belt conveyor 9 conveys the box N from a rear side to a front side in FIG. 2 as a belt 91 (refer to FIG. 3) rotates.

The belt conveyor 9 includes a measuring section 41 that measures a height (i.e., a size) of the box N conveyed by the belt 91 during conveyance of the box N, for example. The measuring section 41 includes a plurality of transmission sensors. The measuring section 41 is described below with reference to FIG. 3. The belt conveyor 9 is provided with a tip detection section 42 which detects a position of the tip of the box N to be conveyed during conveyance of the box N. The tip detection section 42 includes a transmission sensor. The tip detection section 42 is described below with reference to FIG. 3.

Figure 3:
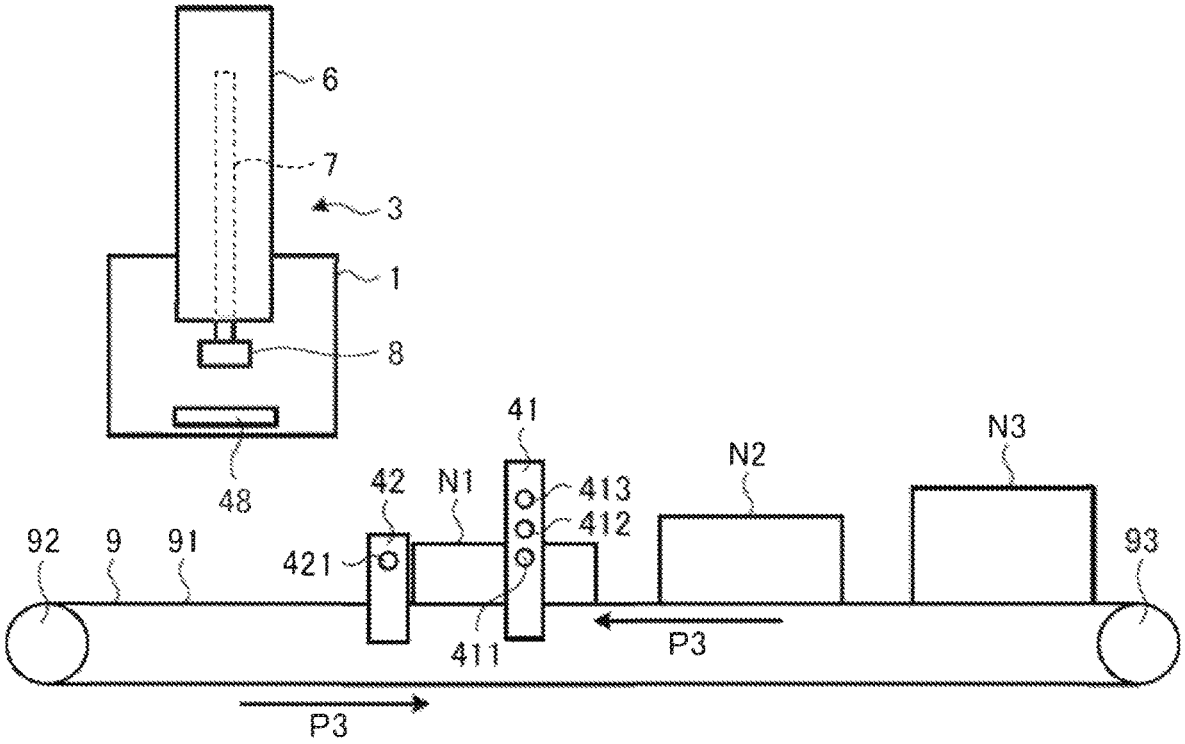
FIG. 3 is a diagram schematically illustrating an example of configurations of the label printer, the labeling apparatus, and the belt conveyor as viewed from an A direction.

FIG. 3 is a diagram schematically illustrating an example of configurations of the label printer 1, the labeling apparatus 3, and the belt conveyor 9 as viewed from an A direction (right lateral direction) in FIG. 2. As shown in FIG. 3, the belt conveyor 9 includes a drive roller 92, a driven roller 93, and the belt 91. When the drive roller 92 rotates, the belt 91 stretched over the drive roller 92 and the driven roller 93 rotates, thereby conveying the box N on the belt 91 in a direction indicated by an arrow P3. The drive roller 92 is driven by a conveyance motor (not shown).

The tip detection sections 42 are provided on both sides of the belt conveyor 9 on an upstream side with respect to the labeling apparatus 3 and the label printer 1. The tip detection section 42 includes a transmission sensor 421. The tip detection section 42 detects a tip position of the box N passing through the tip detection section 42 when the transmission sensor 421 detects the box N conveyed by the belt conveyor 9. The box N of which tip position is detected by the tip detection section 42 is positioned at a predetermined distance from the attaching position where the labeling apparatus 3 attaches the label L to the box N. The box N, of which the tip position is detected by the tip detection section 42, arrives at the attaching position when a certain predetermined period of time elapses. This does not change no matter what size the box is. Of course, the tip detection section 42 may be arranged at the attaching position. The distance between the box N detected by the tip detection section 42 and the attaching position is 0 m, and the certain predetermined period of time is 0 s.

The measuring sections 41 are provided on both sides of the belt conveyor 9 upstream of the tip detection section 42. The measuring section 41 includes three transmission sensors including a first sensor 411, a second sensor 412, and a third sensor 413 from a lower side to an upper side thereof in a height direction of the box N. Here, it is assumed that there are three types of boxes having different heights (i.e., the size of the box). For example, a box N1 is lowest in highest, a box N2 is medium in highest, and the box N3 is highest in highest. The first sensor 411 detects the presence of the box N1, the box N2, and the box N3 conveyed on the belt conveyor 9. The second sensor 412 detects the presence of the box N2 and the box N3 conveyed on the belt conveyor 9. The third sensor 413 detects the box N3 conveyed on the belt conveyor 9. Specifically, when the box N1 passes through the measuring section 41, the presence of the box N is detected by the first sensor 411, but cannot be detected by the second sensor 412 and the third sensor 413. When the box N2 passes through the measuring section 41, the presence of the box N is detected by the first sensor 411 and the second sensor 412, but cannot detected by the third sensor 413. When the box N3 passes through the measuring section 41, the presence of the box N is detected by all of the first sensor 411, the second sensor 412, and the third sensor 413. In other words, output patterns from the first sensor 411, the second sensor 412, and the third sensor 413 vary depending on the height (i.e., size) of the box being conveyed.

Figure 4:
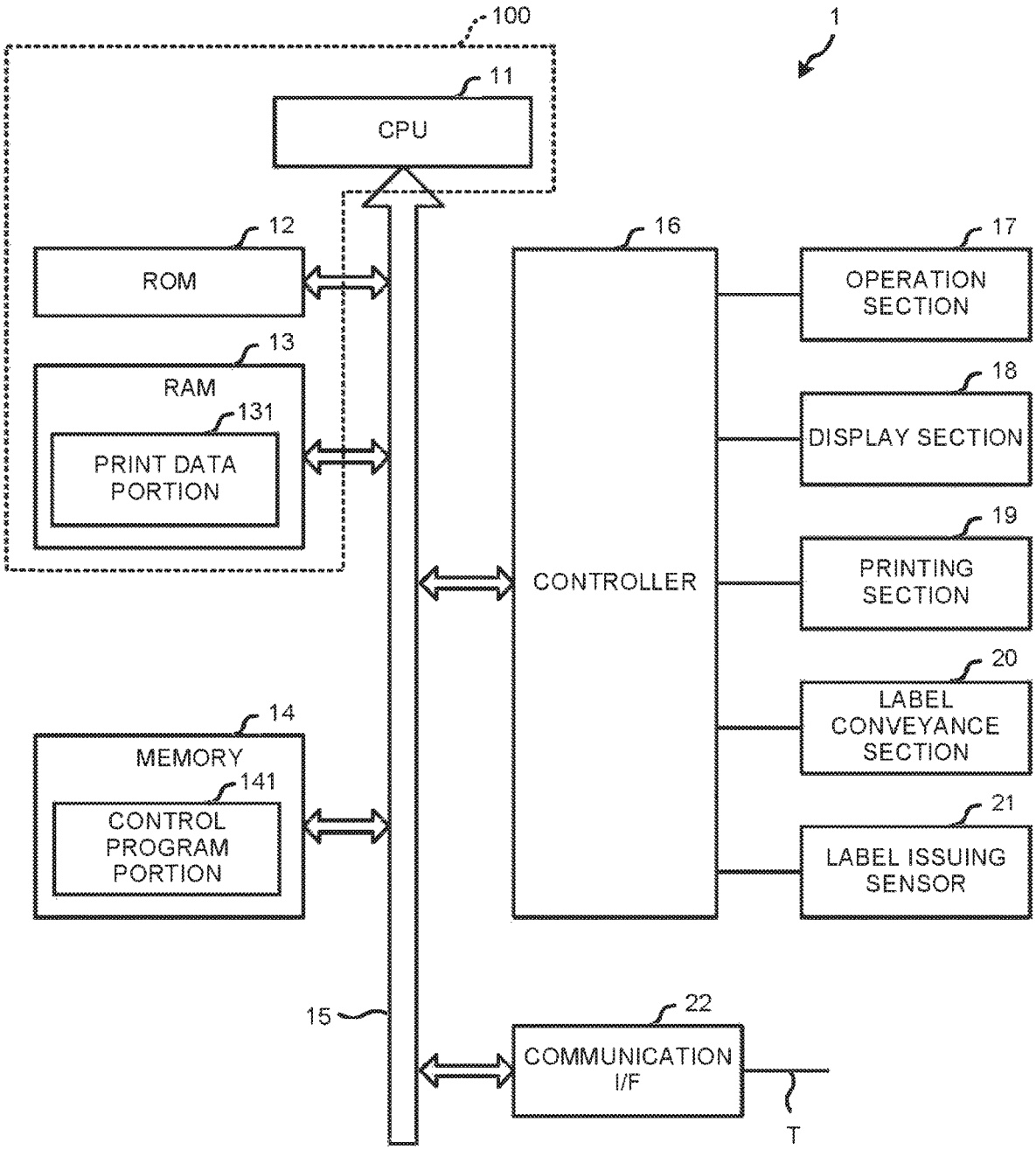
FIG. 4 is a block diagram illustrating a hardware structure of the label printer.

The hardware of the label printer 1 is described below. FIG. 4 is a block diagram illustrating the hardware structure of the label printer 1. As shown in FIG. 4, the label printer 1 includes a CPU (Central Processing Unit) 11 which is an example of the processor, a ROM (Read Only Memory) 12, a RAM (Random Access Memory) 13, a memory 14, and the like. The CPU 11 is a main component for control. The ROM 12 stores various programs. The RAM 13 copies or decompresses programs and various kinds of data. The memory 14 stores various programs. The CPU 11, the ROM 12, the RAM 13, and the memory 14 are connected to one another via a bus 15. The CPU 11, the ROM 12, and the RAM 13 constitute a control section 100. Specifically, the CPU 11 operates according to a control program stored in the ROM 12 or the memory 14 and copied or decompressed to the RAM 13, and in this way, the control section 100 performs a processing of controlling the label printer 1 described below.

The RAM 13 includes a print data portion 131. The print data portion 131 stores print data to be printed on a label, which is received from an information processing apparatus such as a PC (Personal Computer).

The memory 14 is an HDD (Hard Disc Drive), a flash memory, or the like, and retains stored contents even when a power supply thereof is turned off. The memory 14 includes a control program portion 141. The control program portion 141 stores the control program for controlling the label printer 1.

The control section 100 is connected to an operation section 17, a display section 18, a printing section 19, the label conveyance section 20, and the label issuing sensor 21 via the bus 15 and a controller 16.

The operation section 17 is a keyboard for operating the label printer 1. The display section 18 displays information relating to the label printer 1 to an operator. The printing section 19 prints characters, figures, and the like on the label L. The label conveyance section 20 is a motor that rotates the platen 54. The label issuing sensor 21 is a reflection sensor or transmission sensor that detects the presence or absence of the label L1 dispensed to the label issuing port 48.

The control section 100 is also connected to a communication interface (I/F) 22 via the bus 15. The control section 100 can mutually communicate with the labeling apparatus 3 via the communication interface 22.

Figure 5:
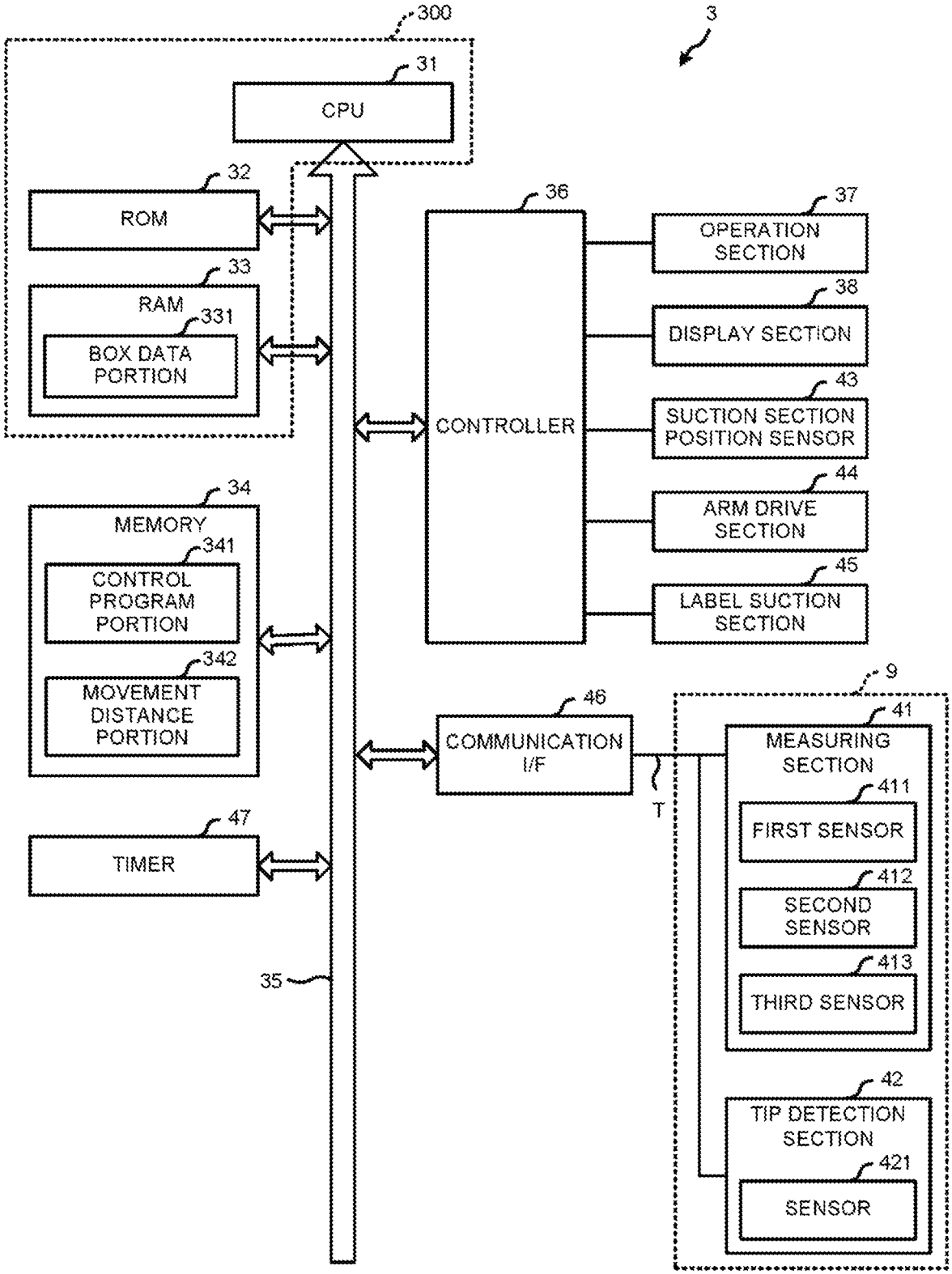
FIG. 5 is a block diagram illustrating a hardware structure of the labeling apparatus.

The hardware of the labeling apparatus 3 is described below. FIG. 5 is a block diagram illustrating the hardware structure of the labeling apparatus 3. As shown in FIG. 5, the labeling apparatus 3 includes a CPU 31, which is an example of the processor, a ROM 32, a RAM 33, the memory 34, and the like. The CPU 31 is a main body for control. The ROM 32 stores various programs. The RAM 33 copies or decompresses programs and various kinds of data. The memory 34 stores various programs. The CPU 31, the ROM 32, the RAM 33, and the memory 34 are connected to one another via a bus 35. The CPU 31, the ROM 32, and the RAM 33 constitute a control section 300. Specifically, the CPU 31 operates according to a control program stored in the ROM 32 or the memory 34 and copied or decompressed to the RAM 33, and in this way, the control section 300 executes a processing of controlling the labeling apparatus 3 described below.

The RAM 33 includes a box data portion 331. The box data portion 331 stores the output from the first sensor 411, the second sensor 412, and the third sensor 413 (output indicating whether the box N is detected or not).

The memory 34 is an HDD, a flash memory, etc., and retains stored contents even when a power supply is turned off. The memory 34 includes a control program portion 341 and a movement distance portion 342. The control program portion 341 stores a control program for controlling the labeling apparatus 3. The movement distance portion 342 is described below with reference to FIG. 6.

The control section 300 is connected to an operation section 37, a display section 38, a suction section position sensor 43, an arm drive section 44, and the label suction section 45 via the bus 35 and a controller 36. The operation section 37 is a keyboard for operating the labeling apparatus 3. The display section 38 displays information to an operator. The suction section position sensor 43 detects whether or not the suction section 8 is positioned at the home position (i.e., a retraction position). The arm drive section 44 is, for example, moves the arm up and down using air pressure. The arm drive section 44 moves the arm in a vertical direction to move the suction section 8 to the home position, the stand by position, or the label attaching position. The label suction section 45 enables the suction section 8 to suck the label L by negative pressure.

The control section 300 is connected to a communication interface (I/F) 46 via the bus 35. The control section 300 can mutually communicate with the label printer 1 and the measuring section 41 and the tip detection section 42 provided on the belt conveyor 9 via the communication interface 46. The measuring section 41 includes the first sensor 411, the second sensor 412, and the third sensor 413. The tip detection section 42 includes the sensor 421. The control section 300 is connected to a timer 47 via the bus 35. The timer 47 counts time and then outputs the counted time.

Figures 6, 7:
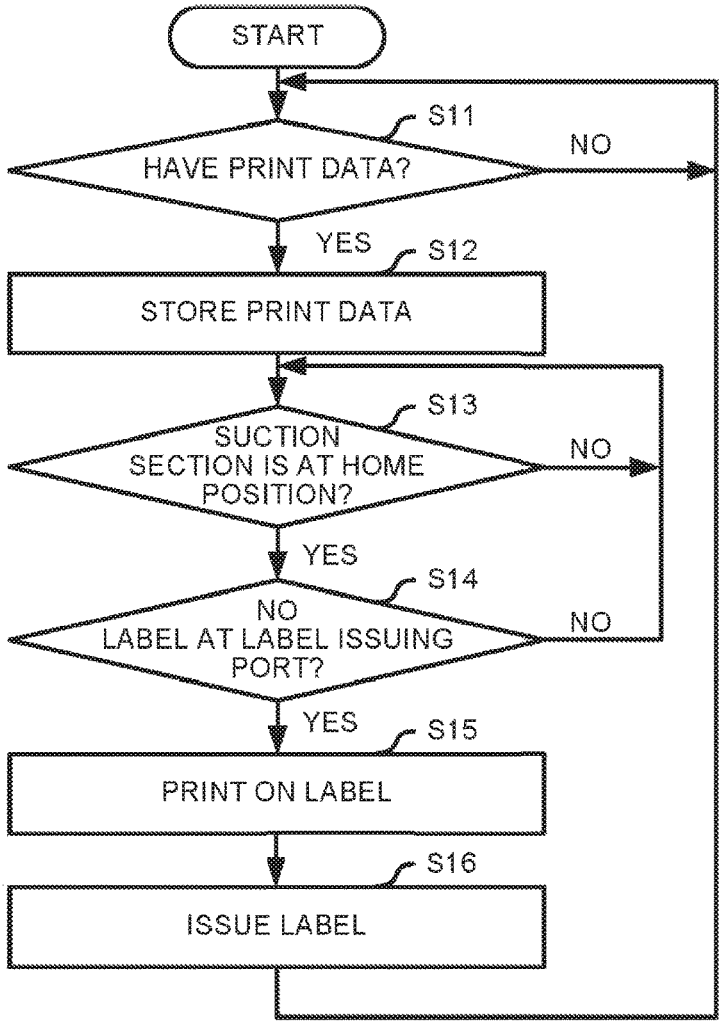
FIG. 6 is a diagram illustrating a memory configuration of a movement distance portion of the labeling apparatus.
FIG. 7 is a flowchart depicting a flow of control processing performed by the label printer.

Next, the movement distance portion 342 is described. FIG. 6 is a diagram illustrating a memory configuration of the movement distance portion 342 of the labeling apparatus 3. As shown in FIG. 6, the movement distance portion 342 stores a movement distance from the home position to the stand by position of the suction section 8 in association with the height (i.e., size) of the box. The movement distance portion 342 includes a box size portion 3421 and a movement distance data portion 3422. The box size portion 3421 stores information indicating the size of the box N (in the embodiment, information relating to the box N1, information relating to the box N2, and information relating to the box N3). The movement distance data portion 3422 stores the data relating to a movement distance by which the suction section 8 is moved from the home position to the stand by position in association with the information indicating the size of the box stored in the box size portion 3421. Specifically, the movement distance portion 3422 stores distance information indicating that the suction section 8 is moved by a first movement distance from the home position to the upper surface of the box N1 in association with the box N1. The movement distance portion 3422 stores distance information indicating that the suction section 8 is moved by a second movement distance from the home position to an upper surface of the box N2 in association with the box N2. The movement distance portion 3422 stores distance information indicating that the suction section 8 is moved by a third movement distance from the home position to an upper surface of the box N3 in association with the box N3. The first movement distance is longer than the second movement distance. The second movement distance is longer than the third movement distance. In other words, the first movement distance is longer than the third movement distance.

The control performed by the label printer 1 is described below. FIG. 7 is a flowchart depicting the flow of control processing performed by the label printer. As shown in FIG. 7, the control section 100 of the label printer 1 determines whether or not print data is received from the information processing apparatus (S11). The control section 100 stands by until the print data is received from the information processing apparatus (No in S11), and if it is determined that the print data is received from the information processing apparatus (Yes in S11), the control section 100 stores the received print data in the print data portion 131 (S12).

Next, the control section 100 determines whether or not the suction section 8 is positioned at the home position based on the output from the suction section position sensor 43 (S13). If it is determined that the suction section 8 is not positioned at the home position (No in S13), the control section 100 stands by until the suction section 8 moves to the home position. If it is determined that the suction unit 8 is positioned at the home position (Yes in S13), the control section 100 determines whether or not there is the label L1 being dispensed in the label issuing position (S14). The control section 100 determines whether there is the label L1 being dispensed based on whether the presence of the label L1 at the label issuing port 48 is detected by the label issuing sensor 21. If the presence of the label L1 at the label issuing port 48 is detected by the label issuing sensor 21, the control section 100 determines that there is the label L1 being dispensed. If the label issuing sensor 21 does not detect the label L1 at the label issuing port 48, the control section 100 determines that there is no label L1 being dispensed. If it is determined that there is the label L1 being dispensed (No in S14), the control section 100 stands by until the presence of the label L1 is not detected by the label issuing sensor 21. If it is determined that there is no label L1 being dispensed (Yes in S14), the control section 100 drives the printing section 19 and the label conveyance section 20 to print the print data stored in the print data portion 131 on the label L1 (S15). Then, the control section 100 drives the label conveyance section 20 to dispense the printed label L1 from the label issuing port 48 (S16). Then, process of the control section 100 returns to S11.

Figure 8:
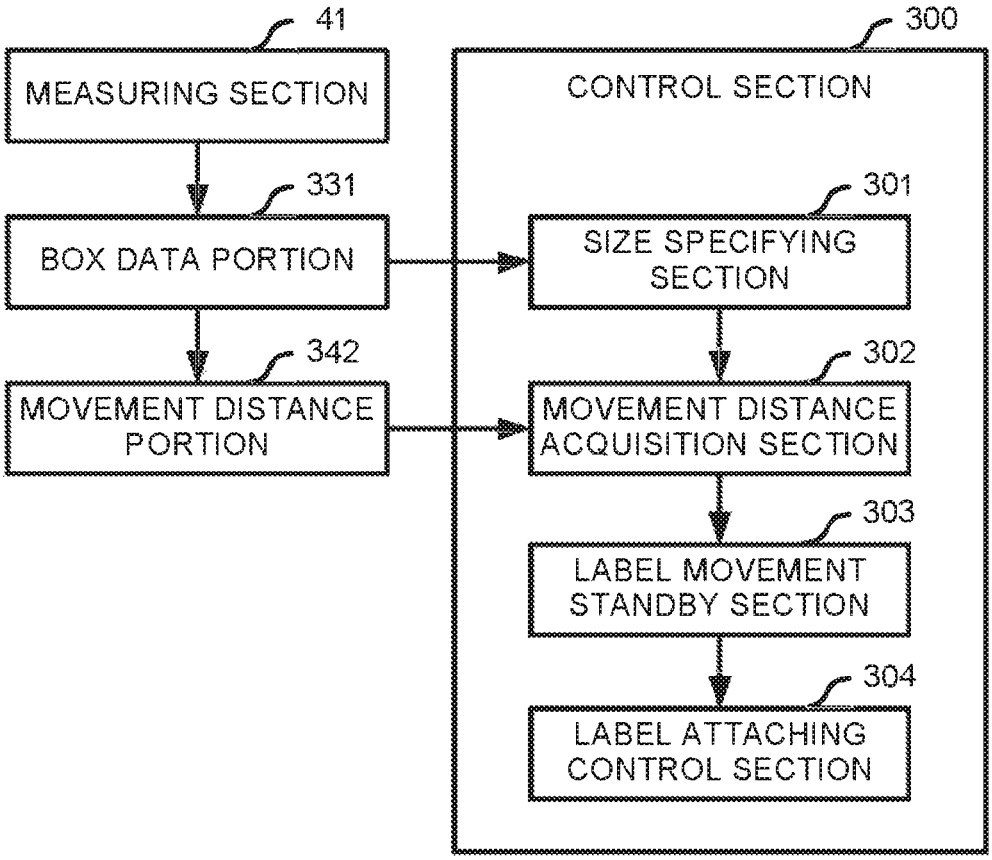
FIG. 8 is a block diagram illustrating functional components of the labeling apparatus.

The functional components of the labeling apparatus 3 are described below. FIG. 8 is a functional block diagram illustrating functional components of the labeling apparatus 3. As shown in FIG. 8, the control section 300 of the labeling apparatus 3 operates according to the control program stored in the control program portion 341 to function as a size specifying section 301, a movement distance acquisition section 302, a label movement standby section 303, and a label attaching control section 304.

The size specifying section 301 has a function of specifying the size of the conveyed box N. Based on the size data of the box N (including the output from the first sensor 411, the output from the second sensor 412 and the output from the third sensor 413) measured by the measuring section 41 and stored in the box data portion 331, the size of the box N is specified. When the output from the first sensor 411 indicates that the box N is detected while the outputs from the second sensor 412 and the third sensor 413 indicate that no box N is detected, the size specifying section 301 specifies that the conveyed box N is the box N1. When the outputs from the first sensor 411 and the second sensor 412 indicate that the box N is detected while the output from the third sensor 413 indicates that no box N is detected, the size specifying section 301 specifies that the conveyed box N is the box N2. When the outputs from the first sensor 411, the second sensor 412, and the third sensor 413 indicate that the box N is detected, the size specifying section 301 specifies that the conveyed box N is the box N3. The size of the box N is measured by the measuring section 41, but it is not limited thereto. For example, the communication I/F 46 may communicate with a server or the like to acquire information relating to the size of the box N. The size specifying section 301 may specify the size of the box based on the acquired information relating to the size of the box N.

The movement distance acquisition section 302 has a function of acquiring different movement distances by which the suction section 8 moves from the home position to the stand by position based on the size of the box N specified by the size specifying section 301. The movement distance acquisition section 302 retrieves the movement distance portion 342 based on the size of the box N specified by the size specifying section 301 to acquire the information relating to the movement distance by which the suction section 8 moves from the home position to the stand by position, which is stored in the movement distance portion 3422 in association with the specified box N. In the embodiment, if the specified box is the box N1, the movement distance acquisition section 302 acquires data of the first movement distance. If the specified box is the box N2, the movement distance acquisition section 302 acquires data of the second movement distance. If the specified box is the box N3, the movement distance acquisition section 302 acquires data of the third movement distance.

The label movement standby section 303 has a function of moving the suction section 8 to the stand by position between the home position and the label attaching position and enabling the label held by the suction section 8 to stand by at the stand by position before the box N is conveyed to the attaching position. The label movement standby section 303 moves the suction section 8 from the home position by the movement distance acquired by the movement distance acquisition section 302 and causes the label L1 to standby at the standby position. When the movement distance acquisition section 302 acquires the data of the first movement distance, the label movement standby section 303 moves the suction section 8 from the home position to the stand by position by the first movement distance. When the movement distance acquisition section 302 acquires the data of the second movement distance, the label movement standby section 303 moves the suction section 8 from the home position to the stand by position by the second movement distance. When the movement distance acquisition section 302 acquires the data of the third movement distance, the label movement standby section 303 moves the suction section 8 from the home position to the stand by position by the third movement distance. The stand by position is separated from the upper surface of the box N by a predetermined distance (for example, 1 cm), and despite that the label movement standby section 303 moves the suction section 8 by the first movement distance, by the second movement distance or by the third movement distance, the stand by position is separated from the box N by the same predetermined distance. When the label movement standby section 303 moves the suction section 8 from the home position to the stand by position, the label movement standby section 303 enables the suction section 8 to suck the label L1 being issued from the label issuing section 48 and moves the label L1 to the stand by position. If the label movement standby section 303 moves the suction section 8 to the stand by position, the label L1 also moves to the stand by position.

When the tip of the box N is detected by the tip detection section 42, the label movement standby section 303 moves the suction section 8 from the home position to the stand by position before the box N is conveyed to the attaching position. In other words, when the box N is conveyed to the attaching position, the suction section 8 and the label L being sucked by the suction section 8 already stand by at the stand by position.

When the box N is conveyed to the attaching position, the label attaching control section 304 attaches the label L1 standby at the stand by position to the box N. The label attaching control section 304 controls the suction section 8 to move the label L standby at the standby position to the label attaching position to attach the label L to the box N.

Figure 9:
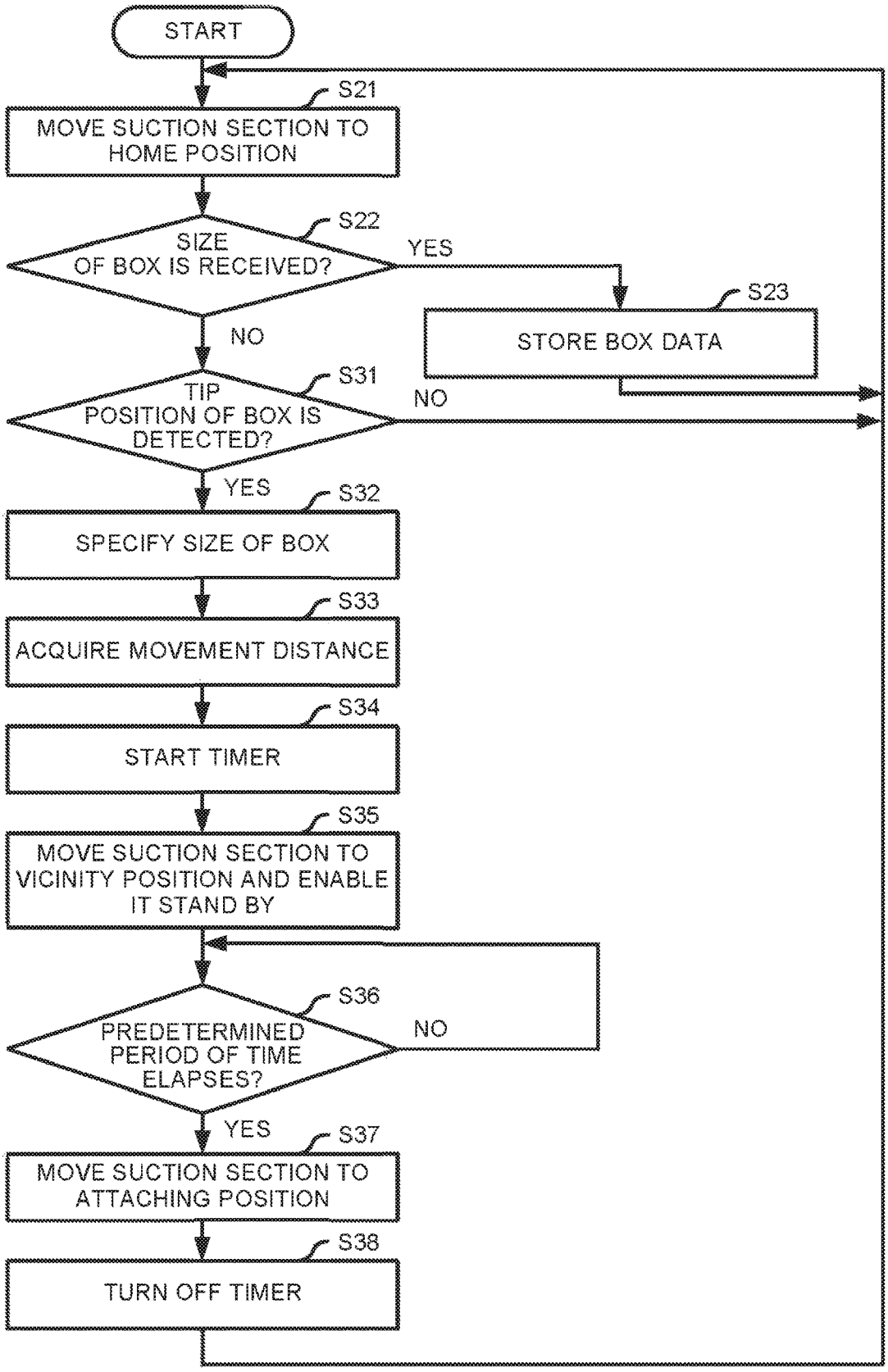
FIG. 9 is a flowchart depicting a flow of control processing performed by the labeling apparatus.

The control processing performed by the labeling apparatus 3 is described below. FIG. 9 is a flowchart depicting the flow of control processing performed by the labeling apparatus 3. The control section 300 of the labeling apparatus 3 moves the suction section 8 to the home position (S21). If the suction section 8 is detected by the suction section position sensor 43, the control section 300 determines that the suction section 8 arrives at the home position. Then, the control section 300 moves the suction section 8 towards the home position until the suction section 8 is detected by the suction section position sensor 43.

Figure 10:
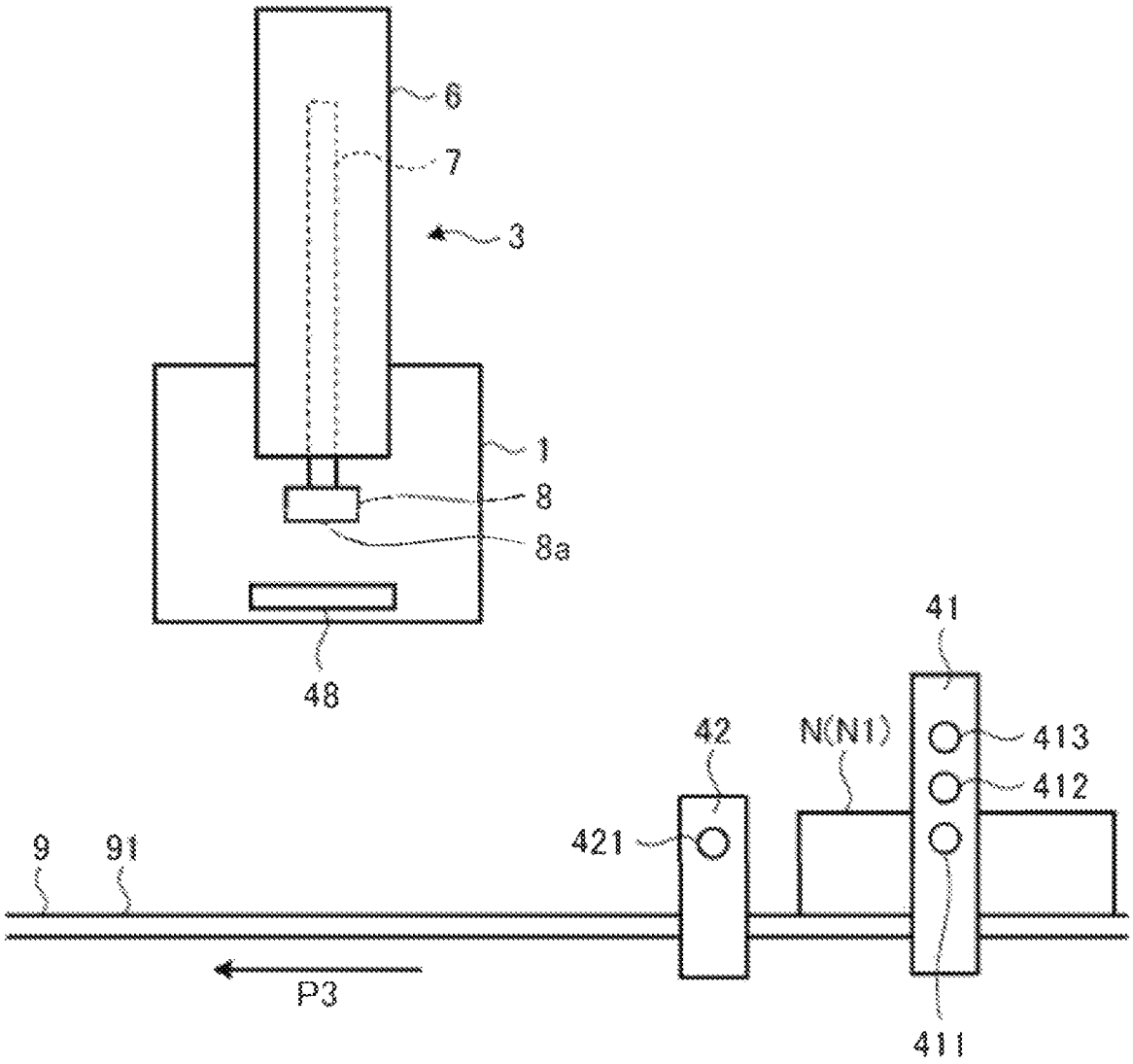
FIG. 10 is a diagram illustrating a state in which a label attaching member is positioned at a home position in the labeling apparatus.

FIG. 10 is a diagram illustrating a state in which the suction section 8 is positioned at the home position. As shown in FIG. 10, the suction section 8 is positioned at the home position above the label issuing section 48.

Next, the control section 300 determines whether or not the information relating to the size of the box N is received from the measuring section 41 via the communication I/F 46 (S22). If it is determined that the information relating to the size of the box N (including the output from the first sensor 411, the output from the second sensor 412 and the output from the third sensor 413) is received from the measuring section 41 (Yes in S22), the control section 300 stores the received information relating to the size of the box N in the box data portion 331 (S23). Then, the process of the control section 300 returns to S21.

In FIG. 10, the first sensor 411 outputs information indicating that the box N is detected. On the other hand, the second sensor 412 and the third sensor 413 output information indicating that no box N is detected. Thus, the measuring section 41 outputs information indicating that the box N1 is detected.

If it is determined that the information relating to the size of the box N is not received (No in S22), the control section 300 determines whether or not the information indicating that the tip of the box N is detected is received from the tip detection section 42 via the communication I/F 46 (S31). If it is determined that the information indicating that the tip of the box N is detected is received (Yes in S31), the size specifying section 301 specifies the size (height) of the conveyed box N based on the information relating to the size of the box N which is stored in the box data portion 331 (S32). Next, the movement distance acquisition section 302 retrieves the movement distance portion 342 based on the specified size of the box N to acquire the movement distance of the suction section 8 (S33). Next, the control section 300 starts the timer 47 (S34). Next, the label movement standby section 303 drives the arm drive section 44 to move the arm 7 and the suction section 8 from the home position to the stand by position (S35). While moving to the stand by position, the suction section 8 suctions the label L1 being dispensed from the label issuing section 48 and conveys the label L1 to the stand by position. Then, the label movement standby section 303 enables the moved label L1 to stand by at the stand by position (S35).

Figure 11:
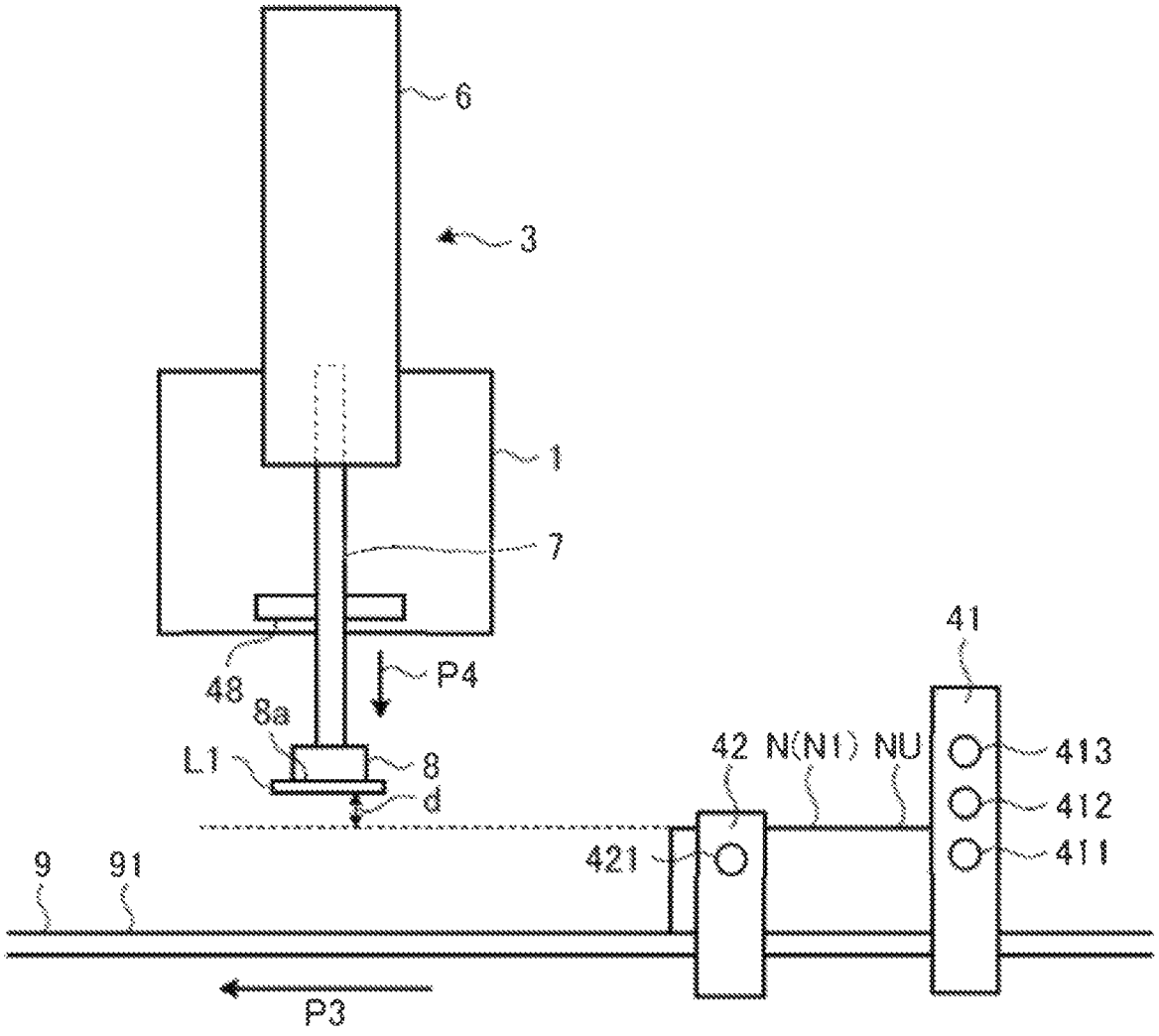
FIG. 11 is a diagram illustrating a state in which the label attaching member is positioned in a stand by position in the labeling apparatus.

FIG. 11 is a diagram illustrating a state in which the suction section 8 is moved to the stand by position in S35. In FIG. 11, the box N (N1) is detected by the tip detection section 42. The arm 7 and the suction section 8 are moved downward (in a direction indicated by an arrow P4) from the home position to the stand by position. The label L1 being sucked by the suction section 8 is moved to the stand by position along with the suction section 8 and stands by at the stand by position. In FIG. 11, the stand by position is separated from the upper surface NU of the box N by a distance d (for example, 1 cm). In FIG. 11, although the box N has not yet reached the attaching position, the label L1 being sucked by the suction section 8 is already positioned at the stand by position, and stands by before the box N is conveyed to the attaching position.

Next, the control section 300 determines whether or not a predetermined period of time elapsed since the timer is started in S34 (S36). If the predetermined period of time elapsed since the timer is started in S34, the box N (whether the box N1 or the box N2 or the box N3) is conveyed to the attaching position. If it is determined that the predetermined period of time elapsed since the timer is started in S34 (Yes in S36), the belt conveyor 9 stops conveying the box N. Then, the label attaching control section 304 moves the suction section 8 from the stand by position to the label attaching position to attach the label L1 to the box N (S37). Then, the control section 300 stops the timer 47 started in S34 (S38). Then, the process of the control section 300 returns to S21. Thereafter, the belt conveyor 9 conveys the box N again. If it is determined that the predetermined period of time has not elapsed since the timer is started in S34 (No in S36), the control section 300 stands by in S36 until the predetermined period of time elapses. If it is determined in S31 that the information indicating that the tip of the box N is detected is not received (No in S31), the process of the control section 300 returns to S21.

Figure 12:
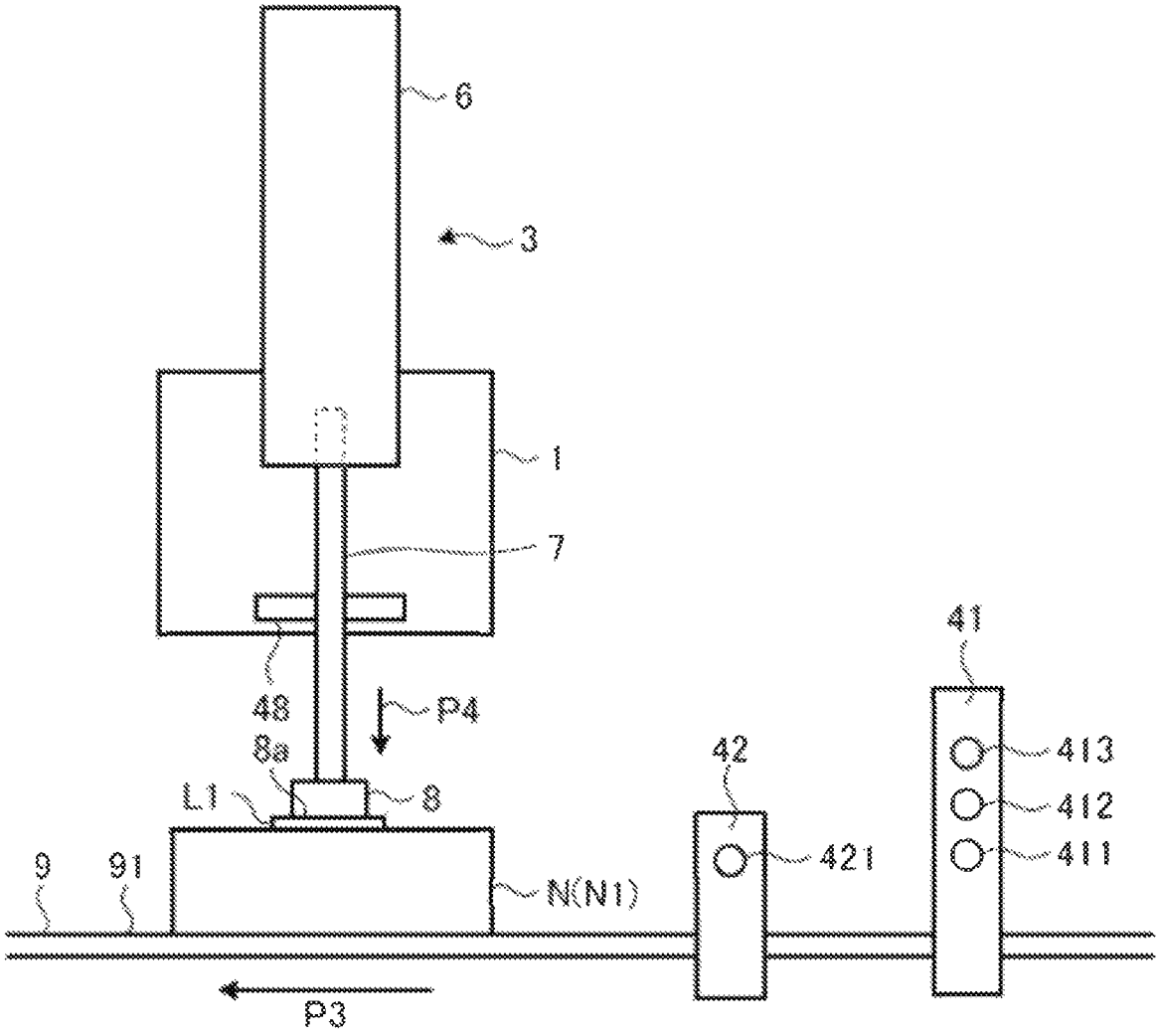
FIG. 12 is a diagram illustrating a state in which the label attaching member is positioned at a label attaching position in the labeling apparatus.

FIG. 12 is a diagram illustrating a state in which the suction section 8 is moved to the label attaching position in S37, and the label L1 is attached to the upper surface NU of the box N positioned at the attaching position.

According to such an embodiment, the suction section 8 and the label L1 move to the stand by position and stand by at the stand by position until the box N is conveyed to the attaching position. Then, when the box N is conveyed to the attaching position, the label L1 standing by at the stand by position is moved to the label attaching position, and the label L1 is then attached to the box N. As a result, it is possible to shorten the movement distance of the label L1 since the conveyance of the box N to the attaching position until the label L1 is attached to the box N. Therefore, when the belt conveyor 9 temporarily stops conveying the box N so as to attach the label L1 to the box N, the stop time can be shortened.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in the embodiment, the label L1 positioned at the standby position is attached to the box N after moving from the stand by position to the label attaching position along with the suction section 8. However, it is not limited to thereto, and for example, the label L1 positioned at the stand by position may be blown off to the label attaching position and attached to the box N by air pressure.

In the embodiment, the box N is described as an example of the object to which the label L1 is attached. However, the labeling apparatus 3 may attach the label L1 to an object other than the box N.

In the embodiment, the label L1 is attached to the box N after the predetermined period of time elapses since the timer 47 is started. This is because that the time required to convey the box N to the attaching position since the tip of the box N1 is detected by the tip detection section 42 is the same whether the box N is the box N1 or the box N2 or the box N3. However, it is not limited thereto. For example, the time required to convey the box N1 to the attaching position since the tip of the box N1 is detected by the tip detection section 42 is set as a predetermined period of time 1; the time required to convey the box N2 to the attaching position since the tip of the box N2 is detected by the tip detection section 42 is set as a predetermined period of time 2; and the time required to convey the box N3 to the attaching position since the tip of the box N3 is detected by the tip detection section 42 is set as a predetermined period of time 3. In this case, since the size of the box N1 is smaller than that of the box N2 and the size of the box N2 is smaller than that of the box N3, the predetermined period of time 1 is shorter than the predetermined period of time 2, and the predetermined period of time 2 is shorter than the predetermined period of time 3. Then, when the box N1 is conveyed, the labeling apparatus 3 attaches the label L1 after the predetermined period of time 1 elapses. When the box N2 is conveyed, the labeling apparatus 3 attaches the label L1 after the predetermined period of time 2 elapses. When the box N3 is conveyed, the labeling apparatus 3 attaches the label L1 after the predetermined period of time 3 elapses.

In the embodiment, the label L1 is attached to the box N after a predetermined period of time elapses since the timer 47 is started. However, it is not limited thereto, for example, a sensor that detects the box N at the attaching position may be provided, and the labeling apparatus 3 attaches the label L1 to the box N when the sensor detects the box N at the attaching position.

In the embodiment, based on the size of the box N specified by the size specifying section 301, the information relating to the movement distance by which the suction section 8 is moved from the home position to the stand by position is acquired. However, it is not limited thereto, for example, the movement distance by which the suction section 8 is moved from the home position to the stand by position may be constant regardless of the size of the box N. For example, whether the box being conveyed is the box N1, the box N2, or the box N3, the suction section 8 is moved by a fourth movement distance. The fourth movement distance is a predetermined movement distance stored in advance in the movement distance portion 342. In this example, the fourth movement distance needs to be equal to or shorter than the third movement distance. Even in this case, it is possible to shorten the movement distance of the label L1 until the label L1 is attached to the box N since the box N is conveyed to the attaching position. Therefore, when the belt conveyor 9 temporarily stops conveying the box N so as to attach the label L1 to the box N, the stop time can be shortened.

What is claimed is:

1. A labeling apparatus comprising:

a label holder configured to move between a retracted position and an extended position that is closer to a conveyer than the retracted position is, and receive a label on an end of the label holder facing the conveyer;

a first sensor above the conveyer at a first position upstream a position facing the label holder in a conveyance direction of the conveyer, the first sensor configured to obtain height information of an object on the conveyer;

a second sensor above the conveyer at a second position upstream the position facing the label holder and downstream the first position in the conveyance direction, the second sensor configured to detect a leading end of the object on the conveyer; and a controller configured to:

determine a moving distance of the label holder up to a standby position between the retracted position and the extended position based on the height information of the object obtained by the first sensor;

upon the second sensor detecting the leading end of the object, control the label holder to move by the determined moving distance to the standby position before the object is conveyed on the conveyer to the position facing the label holder; and after the object is conveyed on the conveyer to the position facing the label holder, control the label holder to move from the standby position towards the extended position to attach the label to the object.

2. The labeling apparatus according to claim 1, wherein the controller is configured to control the label holder to move by a first distance to a first standby position when the object has a first height, and move by a second distance to a second standby position when the object has a second height, the first distance being longer than the second distance and the first height is less than the second height.

3. The labeling apparatus according to claim 1, wherein the standby position is farther from the conveyer than the second sensor is.

4. The labeling apparatus according to claim 1, wherein the label holder is configured to receive the label at a label receiving position between the retracted position and the standby position.

5. The labeling apparatus according to claim 4, further comprising:

a label conveyer configured to convey the label toward a moving path of the label holder such that the label holder receives the label at the label receiving position.

6. The labeling apparatus according to claim 5, wherein the label receiving position is closer to the retracted position than the standby position.

7. The labeling apparatus according to claim 1, wherein the label holder holds the label by suction.

8. The labeling apparatus according to claim 1, wherein the first sensor includes a plurality of sensing elements provided at different heights above the conveyer and obtains the height information of the object based on detection and non-detection by each of the sensing elements when the object on the conveyer passes the first sensor.

9. The labeling apparatus according to claim 1, wherein upon the second sensor detecting the leading end of the object, the controller controls the label holder to move from the retracted position to the standby position.

10. A method for attaching a label on an object on a conveyor, the method comprising:

receiving the label on an end of a label holder facing the conveyer;

obtaining height information of the object on the conveyer with a first sensor above the conveyer at a first position upstream a position facing the label holder in a conveyance direction of the conveyer;

determining a moving distance of the label holder up to a standby position between the retracted position and the extended position based on the height information of the object obtained by the first sensor;

detecting a leading end of the object on the conveyer with a second sensor above the conveyer at a second position upstream the position facing the label holder and downstream the first position in the conveyance direction;

upon detecting the leading end of the object, controlling the label holder to move by the determined moving distance to the standby position before the object is conveyed on the conveyer to the position facing the label holder; and after the object is conveyed on the conveyer to the position facing the label holder, controlling the label holder to move from the standby position toward the extended position to attach the label to the object by the label holder.

11. The method according to claim 10, wherein said controlling the label holder to move by the determined moving distance to the standby position comprises:

controlling the label holder to move by a first distance to a first standby position when the object has a first height, and controlling the label holder to move by a second distance to a second standby position when the object has a second height, the first distance being longer than the second distance and the first height is less than the second height.

12. The method according to claim 10, wherein the standby position is farther from the conveyer than the second sensor is.

13. The method according to claim 10, wherein the label is received on the end of the label holder when the label holder is at a label receiving position between the retracted position and the standby position.

14. The method according to claim 13, further comprising:

conveying the label to the label holder such that the label holder receives the label at the label receiving position.

15. The method according to claim 14, wherein the label receiving position is closer to the retracted position than the standby position.

16. The method according to claim 10, further comprising:

holding the label at the end of the label holder with suction.

17. The method according to claim 10, wherein the first sensor includes a plurality of sensing elements provided at different heights above the conveyer, and the height information of the object is obtained based on detection and non-detection by each of the sensing elements when the object on the conveyer passes the first sensor.

18. The method according to claim 10, wherein upon the second sensor detecting the leading end of the object, the label holder is controlled to move from the retracted position to the standby position.

* * * * *